US011703303B1

(12) United States Patent
Bray

(10) Patent No.: US 11,703,303 B1
(45) Date of Patent: Jul. 18, 2023

(54) AIR GUN MODERATOR AND MULTI-LAYER MODERATOR CORE

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 18/120,320

(22) Filed: Mar. 10, 2023

(51) Int. Cl.
*F41B 11/70* (2013.01)
*F41A 21/32* (2006.01)

(52) U.S. Cl.
CPC ..... *F41B 11/70* (2013.01); *F41A 21/32* (2013.01)

(58) Field of Classification Search
CPC ..... F41B 11/70; F41A 21/30; F41A 21/32; F41A 21/02
USPC ..... 124/83; 89/14.3, 14.4
See application file for complete search history.

(56) References Cited

U.S. PATENT DOCUMENTS 1,017,003 A * 2/1912 Kenney ..... F41A 21/30 89/14.4
1,066,898 A * 7/1913 Gray ..... F41A 21/30 181/223
1,111,202 A * 9/1914 Westfall ..... F41A 21/30 89/14.4
2,514,996 A * 7/1950 Faust, Jr. ..... F41A 21/34 181/223
3,385,164 A * 5/1968 Hubner ..... F41A 21/30 181/269
3,667,570 A * 6/1972 WerBell, III ..... F41A 21/30 89/14.4
4,576,083 A * 3/1986 Seberger, Jr. ..... F01N 1/08 89/14.4
6,374,718 B1 * 4/2002 Rescigno ..... F41A 21/30 89/14.4
6,575,074 B1 * 6/2003 Gaddini ..... F41A 21/30 89/14.4
6,796,214 B2 * 9/2004 Hausken ..... F41A 21/30 89/14.4
8,196,701 B1 * 6/2012 Oliver ..... F41A 21/30 89/14.4
8,261,651 B2 * 9/2012 Casas Salva ..... F41A 21/30 89/14.4

(Continued)

FOREIGN PATENT DOCUMENTS

RU 2438086 C2 2/2011

*Primary Examiner* — Alexander R Niconovich
(74) *Attorney, Agent, or Firm* — Kunzler Bean & Adamson

(57) ABSTRACT

Embodiments of the present disclosure include a moderator having a housing configured to attach to an air gun. The housing includes a first material configured to yield and/or fracture in response to exposure to at least one of a pressure level resulting from discharging a firearm and/or a temperature resulting from discharging a firearm and a number of openings positioned in proximity to an end of the housing. The moderator also includes a number of plugs. Each plug includes a second material configured to yield and/or fracture in response to exposure to at least one of a pressure level resulting from discharging a firearm and/or a temperature resulting from discharging a firearm. Each opening of the number of openings is configured to receive a plug of the number of plugs.

20 Claims, 7 Drawing Sheets

(56) References Cited

U.S. PATENT DOCUMENTS 8,505,680 B2 * 8/2013 Dueck ..... F41A 21/34 89/14.4
8,776,771 B1 * 7/2014 Yang ..... F42B 12/40 124/71
8,857,307 B2 * 10/2014 Tresserras Torre ... F41A 21/325 89/14.05
8,950,310 B2 * 2/2015 Storrs ..... F01N 3/02 89/14.1
8,978,818 B2 * 3/2015 Proske ..... F41A 21/30 89/14.4
9,115,950 B2 * 8/2015 Bethlenfalvy ..... F41A 21/30
9,207,033 B2 * 12/2015 Vais ..... F41A 21/30
9,261,316 B2 * 2/2016 Arnedo Vera ..... F41A 21/02
9,291,417 B2 * 3/2016 James ..... F41A 21/30
9,347,727 B1 * 5/2016 Cler ..... F41A 21/30
9,476,662 B2 * 10/2016 Fischer ..... F41A 21/30
9,482,483 B2 * 11/2016 Whelan ..... F41A 21/30
9,593,899 B2 * 3/2017 Coppinger ..... F41A 21/30
10,012,464 B2 * 7/2018 Bray ..... F41A 21/34
10,054,384 B1 * 8/2018 Marfione ..... F41A 21/30
10,113,826 B2 * 10/2018 Bray ..... F41A 21/30
10,119,779 B1 * 11/2018 Miele ..... F41A 21/30
10,228,210 B2 * 3/2019 Parker ..... F41A 21/30
10,267,586 B1 * 4/2019 Marfione ..... F41A 21/30
10,317,161 B2 * 6/2019 Arnedo Vera ..... F41A 21/02
10,451,374 B2 * 10/2019 Palu ..... F41A 21/30
10,563,944 B2 * 2/2020 Campbell ..... F41A 21/30
RE47,932 E * 4/2020 Young ..... F41A 21/30
10,619,962 B1 * 4/2020 Hatfield ..... F41A 21/44
10,619,963 B2 * 4/2020 Petersen ..... F41A 21/30
10,655,926 B2 * 5/2020 Young ..... F41A 21/30
10,852,091 B1 * 12/2020 Helms ..... F41A 21/30
10,907,920 B2 * 2/2021 Walker ..... F41A 21/30
10,921,080 B2 * 2/2021 Hibbitts ..... F41A 21/44
11,092,399 B2 * 8/2021 Washburn, III ..... F41A 21/30
11,112,200 B2 * 9/2021 Lawson ..... F41A 21/30
11,268,778 B2 * 3/2022 Wilson ..... F41A 21/30
11,435,156 B1 * 9/2022 Dellinger ..... G10K 11/165
11,614,298 B2 * 3/2023 Bray ..... F41A 21/30 89/14.4
2005/0066954 A1 * 3/2005 Williams ..... F42B 10/26 124/83
2011/0297477 A1 * 12/2011 Koumbis ..... F41A 21/325 181/223
2012/0152093 A1 * 6/2012 Koumbis ..... F41A 21/30 89/14.4
2013/0227871 A1 * 9/2013 Stone ..... F41A 21/30 42/76.1
2016/0076844 A1 * 3/2016 Miller, III ..... F41A 21/30 89/14.3
2016/0209150 A1 * 7/2016 Smith ..... F41A 21/30
2017/0074613 A1 * 3/2017 Shults ..... F41A 21/30
2018/0164065 A1 * 6/2018 Mohler ..... F41A 21/30
2019/0128631 A1 * 5/2019 Tonkin ..... F41A 21/28
2019/0376758 A1 * 12/2019 Tiziani ..... F41A 21/34
2020/0025494 A1 * 1/2020 Parker ..... F41A 21/30
2021/0041200 A1 * 2/2021 Kras ..... F41A 21/30
2021/0180902 A1 * 6/2021 Bray ..... F41A 21/30
2021/0239419 A1 * 8/2021 Lo ..... F41A 21/30
2022/0099401 A1 * 3/2022 Langenbeck ..... F41A 21/482
2022/0268549 A1 * 8/2022 Caudle ..... F41B 11/70
2022/0397362 A1 * 12/2022 DeJessa ..... F41A 21/30
2022/0399001 A1 * 12/2022 McCaslin ..... F41B 11/70

* cited by examiner

AIR GUN MODERATOR AND MULTI-LAYER MODERATOR CORE

FIELD

This disclosure relates generally to moderators, and more particularly to moderators suitable for use with air guns and multi-layer moderator cores for use with air guns and/or firearms.

BACKGROUND

Firearm suppressors can be attached to firearms such that when a projectile is discharged from the firearm, the projectile passes through the firearm suppressor. A firearm suppressor helps to reduce noise associated with the discharge of a projectile from the firearm. The use of firearm suppressors is subject to regulation. For example, according to the Gun Control Act (18 U.S.C. § 921(A) (25), "GCA"), "any device for silencing, muffling, or diminishing the report of a portable firearm, including any combination of parts, designed or redesigned, and intended for the use in assembling or fabricating a firearm silencer or firearm muffler, and any part intended only for use in such assembly or fabrication", is subject to control under the GCA and the National Firearms Act (26 U.S.C. § 53, "NFA"). On the other hand, air guns and air gun moderators, when intended for use to help reduce noise associated with the discharge of projectiles from air guns, are generally not subject to these controls. However, many air gun moderators can be repurposed as firearm suppressors.

SUMMARY

Embodiments of the present disclosure include an air gun moderator having a housing configured to attach to an air gun. The housing includes a first material configured to yield and/or fracture in response to exposure to at least one of a pressure level resulting from discharging a firearm and/or a temperature resulting from discharging a firearm and a number of openings positioned in proximity to an end of the housing. The air gun moderator also includes a number of plugs. Each plug includes a second material configured to yield and/or fracture in response to exposure to at least one of a pressure level resulting from discharging a firearm and/or a temperature resulting from discharging a firearm. Each opening of the number of openings is configured to receive a plug of the number of plugs.

Embodiments of the present disclosure also include an air gun moderator having a housing configured to attach to an air gun. The housing includes a depression, the depression having a depth configured to reduce a thickness of a portion of the housing with respect to a remainder of the housing and sufficient to cause the housing to yield and/or fracture in response to exposure to at least one of a pressure level resulting from discharging a firearm and/or a temperature resulting from discharging a firearm. The moderator includes a first chamber disposed within the housing and positioned such that a projectile discharged from the air gun passes through an entrance to the first chamber. The moderator includes a second chamber disposed within the housing and positioned such that the projectile passes through an entrance to the second chamber after passing through the entrance to the first chamber. The depression is positioned between the entrance to the first chamber and the entrance to the second chamber.

Embodiments of the present disclosure include a method of manufacturing a moderator for an air gun. The method includes forming a housing. The housing includes a first end configured to attach to an air gun, a hollow portion, and a first material configured to yield and/or fracture in response to exposure to at least one of a pressure level resulting from discharge of a firearm and/or a temperature resulting from discharge of a firearm. The method includes forming a number of openings in the housing. The method includes forming a depression within the hollow portion. The depression has a depth configured to reduce a thickness of a portion of the housing with respect to a remainder of the housing and cause the housing to yield and/or fracture in response to exposure to at least one of a pressure level resulting from discharge of a firearm and/or a temperature resulting from discharge of a firearm. The method includes positioning a core within the hollow portion. The core includes a number of chambers configured to receive a projectile discharged from the gun and a second material configured to yield and/or fracture in response to exposure to at least one of a pressure level resulting from discharge of a firearm and/or a temperature resulting from discharge of a firearm. The method includes positioning a number of plugs within the number of openings, each plug comprising a material configured to yield and/or fracture in response to exposure to at least one of a pressure level resulting from discharge of a firearm and/or a temperature resulting from discharge of a firearm.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
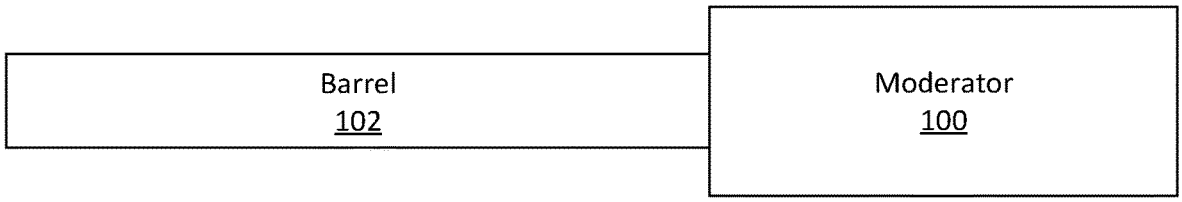
FIG. 1 is a schematic block diagram illustrating one embodiment of an air gun moderator attached to a barrel of a gun in accordance with one or more embodiments of the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Embodiments of the present disclosure include an air gun moderator having a housing configured to attach to an air gun. The housing includes a first material configured to yield and/or fracture in response to exposure to at least one of a pressure level resulting from discharging a firearm and/or a temperature resulting from discharging a firearm and a number of openings positioned in proximity to an end of the housing. The air gun moderator also includes a number of plugs. Each plug includes a second material configured to yield and/or fracture in response to exposure to at least one of a pressure level resulting from discharging a firearm and/or a temperature resulting from discharging a firearm. Each opening of the number of openings is configured to receive a plug of the number of plugs.

In some embodiments, each of the first material and the second material are further configured not to yield or fracture at a temperature and pressure level resulting from discharging the air gun. At least one of the first material and the second material is configured to yield and/or fracture at a temperature that is sufficiently low to render the at least one material unsuitable for use if the moderator is attached to a firearm. In some embodiments, the at least one material is configured to yield and/or fracture at a temperature no greater than 215 degrees Fahrenheit.

In some embodiments, the housing includes at least one of the following: a depression, a number of holes extending only partially through the housing, and/or fluting positioned on an exterior surface of the housing.

In some embodiments, the housing includes a hollow portion. The housing includes an interior surface facing the hollow portion. In some embodiments, the housing is substantially cylindrical in shape, and the depression spans a circumference of the hollow portion. In some embodiments, the moderator includes a core disposed within the hollow portion. The core includes a first chamber configured to receive a projectile from the gun and a second chamber configured to receive the projectile from the first chamber. In some embodiments, the depression is positioned between an entrance to the first chamber and an entrance to the second chamber.

In some embodiments, the core includes a third material with a yield and tensile strength sufficiently low such that the third material deforms or fractures in response to exposure to at least one of a temperature resulting from discharging a firearm and/or a pressure level resulting from discharging a firearm.

In some embodiments, the moderator includes an attachment element positioned at the end and configured to removably attach to at least one of a muzzle, a barrel, or a shroud of the air gun.

In some embodiments, the number of plugs are further configured to yield and/or fracture at a temperature that is less than a temperature at which the housing is configured to yield and/or fracture.

In some embodiments, the first material includes an aluminum alloy. In some embodiments, the first material has a sufficiently low tensile and yield strength such that at least one of the moderator or a component of the moderator is not compatible with a gun attached to the housing if the gun is a firearm.

In some embodiments, the moderator includes a cap configured to attach to a second end of the housing. The cap includes at least one opening configured to allow a projectile fired from an air gun to pass through the cap.

Embodiments of the present disclosure also include an air gun moderator having a housing configured to attach to an air gun. The housing includes a depression, the depression having a depth configured to reduce a thickness of a portion of the housing with respect to a remainder of the housing and sufficient to cause the housing to yield and/or fracture in response to exposure to at least one of a pressure level resulting from discharging a firearm and/or a temperature resulting from discharging a firearm. The moderator includes a first chamber disposed within the housing and positioned such that a projectile discharged from the air gun passes through an entrance to the first chamber. The moderator includes a second chamber disposed within the housing and positioned such that the projectile passes through an entrance to the second chamber after passing through the entrance to the first chamber. The depression is positioned between the entrance to the first chamber and the entrance to the second chamber.

In some embodiments, the first chamber and the second chamber are a first and second chamber of a number of chambers of a core disposed within the housing. The core includes a material configured to yield and/or fracture in response to exposure to at least one of a pressure level resulting from a discharging of a projectile from a firearm through the entrance to the first chamber and/or a temperature resulting from a discharging of a projectile from a firearm to the entrance of the first chamber. The material is also configured to not yield in response to a discharging of a projectile from the air gun and through the entrance to the first chamber. In some embodiments, the first chamber and the second chamber are a first and second chamber of a number of chambers. The core includes baffles between each chamber. Each baffle is configured to permit a projectile discharged from a gun to pass through the baffle.

In some embodiments, the material is a first material. The housing includes a second material configured to yield and/or fracture in response to exposure to at least one of a pressure level resulting from discharging a firearm and/or a temperature resulting from discharging a firearm. In some embodiments, the material is configured to yield and/or fracture at a temperature of no greater than 215 degrees Fahrenheit.

Embodiments of the present disclosure include a method of manufacturing a moderator for an air gun. The method includes forming a housing. The housing includes a first end configured to attach to an air gun, a hollow portion, and a first material configured to yield and/or fracture in response to exposure to at least one of a pressure level resulting from discharge of a firearm and/or a temperature resulting from discharge of a firearm. The method includes forming a number of openings in the housing. The method includes forming a depression within the hollow portion. The depression has a depth configured to reduce a thickness of a portion of the housing with respect to a remainder of the housing and cause the housing to yield and/or fracture in response to exposure to at least one of a pressure level resulting from discharge of a firearm and/or a temperature resulting from discharge of a firearm. The method includes positioning a core within the hollow portion. The core includes a number of chambers configured to receive a projectile discharged from the air gun and a second material configured to yield and/or fracture in response to exposure to at least one of a pressure level resulting from discharge of a firearm and/or a temperature resulting from discharge of a firearm. The method includes positioning a number of plugs within the number of openings, each plug comprising a material configured to yield and/or fracture in response to exposure to at least one of a pressure level resulting from discharge of a firearm and/or a temperature resulting from discharge of a firearm.

FIG. 1 is a schematic block diagram illustrating one embodiment of an air gun moderator 100 attached to a barrel 102 of a gun in accordance with one or more embodiments of the present invention. Although FIG. 1 shows the moderator 100 attached directly to the barrel 102, embodiments of the present disclosure are not so limited. For example, the moderator 100 is attached to a barrel shroud, which, in some examples, includes an external covering that either partially or fully envelops the barrel 102. In other examples, the moderator 100 is attached to a muzzle of the gun.

When a projectile is discharged from the gun, the projectile travels through the barrel 102 and then through the moderator 100. The moderator 100 helps to reduce noise associated with the discharge.

As discussed above, the use of moderators in connection with firearms is subject to regulation with criminal liability. Although air gun moderators and air guns are not subject to the same regulations as firearms and firearm moderators, many air gun moderators can be repurposed as firearm moderators. Embodiments of the present disclosure include air gun moderators that reduce the likelihood of being illegally repurposed for use with firearms.

Embodiments of the present disclosure also include moderator components, such as multi-layer moderator cores 206, that help to reduce blowby effects and sound associated with discharging of projectiles, thereby also helping to increase accuracy.

Figure 2:
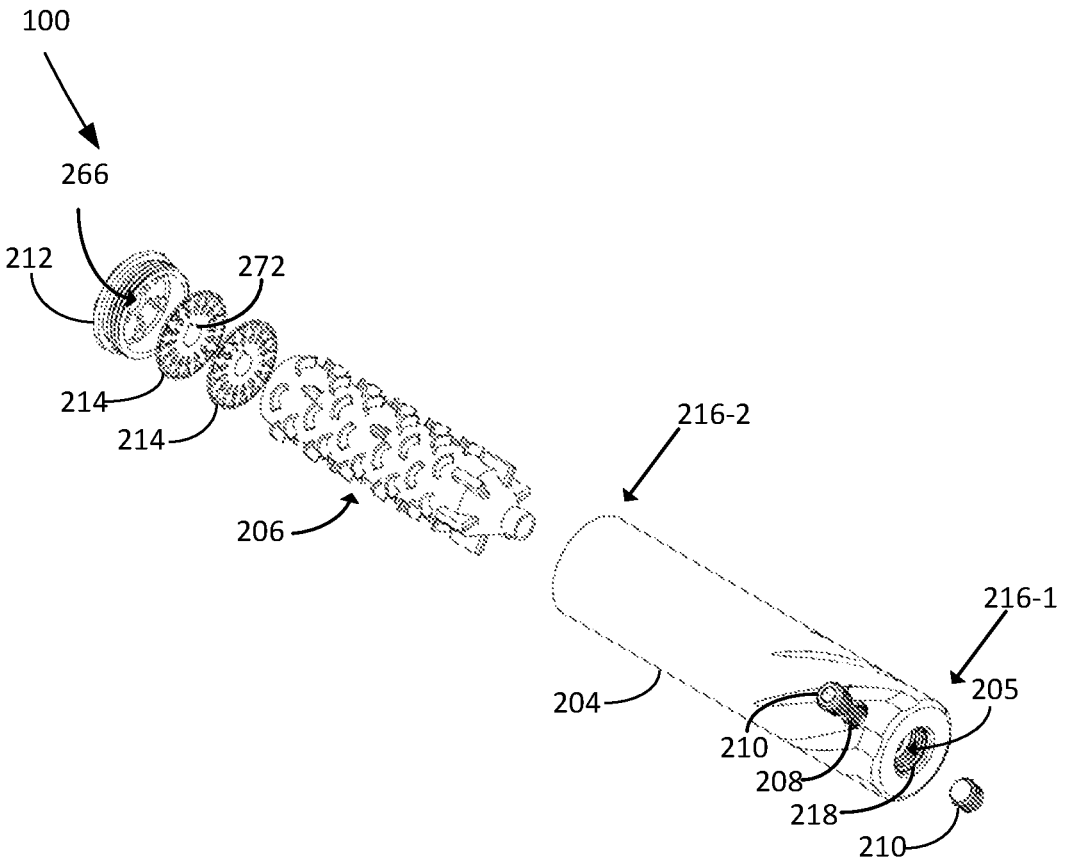
FIG. 2 is an exploded view illustrating one embodiment of an air gun moderator 100 in accordance with one or more embodiments of the present invention.

FIG. 2 is an exploded view illustrating one embodiment of an air gun moderator 100 in accordance with one or more embodiments of the present invention. An air gun moderator 100 includes a housing 204 configured to attach to a gun. For example, the housing 204 is attached to a gun via an attachment element 218 at a proximal end 216-1 of the housing 204. The housing 204 includes a number of openings 208 positioned in proximity to the proximal end 216-1. The moderator also includes a number of plugs 210. Each opening 208 is configured to receive a plug 210. In some embodiments, the moderator 100 also includes a hollow portion 205 configured to receive a core 206.

In some embodiments, the housing 204 is made of a material that is not suitable for use with firearms but is suitable for use with air guns. In other words, the housing 204 includes a material that would deform and/or deteriorate if the housing 204 were attached to a firearm rather than an air gun. The material of the housing 204 yields in response to exposure to at least one of a pressure level resulting from discharging a firearm (e.g., an exit pressure level) and/or a temperature resulting from discharging a firearm. The material makes the moderator 100 and/or a component of the moderator (e.g., the housing 204) incompatible for use with a gun attached to the housing 204 if the gun is a firearm.

In some embodiments, the housing 204 is configured to be attached to an air gun. Although, in some embodiments, the housing 204 includes a material that is not compatible for use with a firearm, the material of the housing 204 is compatible for use with an air gun. The material is of sufficient tensile and yield strength to withstand any increases in pressure and/or temperature caused by discharging an air gun to which the housing 204 is attached. In some embodiments, the material of the housing 204 has a yield point such that, when a force typically resulting from discharging a firearm is applied to the housing, the housing begins to exhibit plastic behavior rather than elastic behavior. The yield point of the material of the housing 204 is such that, if the material is subject to an amount of force typical from discharging of a firearm, the material will experience at least some permanent deformation. However, the amount of force that the moderator 100 would be subject to from the discharge of a typical air gun is less than the force associated with discharging a firearm. Hence, the yield point of the material of the housing 204 is such that the material does not undergo any permanent deformation as a result of the force from the air gun discharging.

In some examples, the housing 204 includes a 3-D printed material. Examples of such materials include, but are not limited to: polyactic acid, high-strength polyactic acid, acrylonitrile butadiene styrene ("ABS"), polycarbonate ("PC"), glycol-modified polyethylene terephthalate ("PET-G"), nylon, and polypropylene ("PP") carbon fiber impregnated nylon.

For example, the material of the housing 204 includes certain aluminum alloys with sufficient tensile and yield strength to withstand the pressure levels of an air gun's discharge but insufficient tensile and yield strength to withstand a firearm discharge. For example, the aluminum alloy 6061 has sufficient tensile and yield strength not to yield or fracture upon exposure to an air gun discharge but may not have sufficient tensile and yield strength to withstand a firearm discharge. In some examples, the aluminum alloy material includes no more than 0.25% zinc by weight. The aluminum alloy material includes no more than 1.2% magnesium by weight. In some embodiments, the aluminum alloy material includes at least 92% aluminum by weight. In some embodiments, the Young's modulus of a material of the housing 204 is less than 70 gigapascals ("GPa"). However, embodiments of the present disclosure are not so limited. The housing 204 may be formed of any material with a yield and tensile strength suitable to withstand discharge of air from an air rifle but configured to yield when exposed to the hot burning gasses discharged from a firearm.

In some embodiments, the material of the housing 204 has a particular temperature limit. The material of the housing 204 is likely to yield and/or fracture upon exposure to a temperature that exceeds the temperature limit. In some embodiments, this temperature limit is lower than a temperature commonly experienced by moderators attached to firearms as a result of discharging the firearm. However, the temperature limit is equal to or higher than temperatures that would typically be experienced upon discharge of an air gun. In some embodiments, the temperature limit is no greater than 215 degrees Fahrenheit.

In some embodiments, each plug 210 is also made of a material that is not suitable for use with firearms but is suitable for use with air guns. The material yields and/or fractures in response to exposure to at least one of a pressure level resulting from discharging a firearm and/or a temperature resulting from discharging a firearm. For example, the material of the plugs 210 includes, but is not limited to: a polymeric material, a resin, a low-grade metallic material, or any combination thereof. In some embodiments, the plugs 210 include such a material, but the housing 204 only includes materials suitable to withstand a firearm discharge. As such, the plugs 210 allow for more options for housing 204 materials while helping to ensure that the moderator will not be compatible with firearm use.

In some embodiments, the materials of the plugs 210 and the housing 204 are configured to yield and/or fracture at a temperature of 300 degrees Fahrenheit or less. In some embodiments, the materials of the plugs 210 and the housing 204 are configured to yield and/or fracture at a temperature of 215 degrees Fahrenheit or less. In some embodiments, the materials of the plugs 210 are materials that yield or fracture at a temperature that is less than the temperature at which the material of the housing 204 yields or fractures. For example, in some embodiments, the housing 204 includes 6061 Aluminum, and the plugs 210 are made of polymeric material with a yield point that is less than that of 6061 Aluminum. In other embodiments, the housing 204 includes a material with sufficient tensile and yield strength to withstand discharge of a firearm, such as 7075-T6 Aluminum, but the housing 204 is still incompatible for use with a firearm, because the plugs 210 include a material with insufficient tensile and yield strength. In some embodiments, the openings 208 receiving the plugs 210 are positioned on the housing 204 such that, if the plugs yield and/or fracture due to the discharge of a firearm, the hot, high-pressure gasses from the firearm vent through the openings 208 prior to flowing through the moderator 100, which negates the quieting benefits of a firearm silencer or muffler. For example, as illustrated in FIG. 3B, the openings 208 are positioned in proximity to the first chamber 370-1, which, in some embodiments, is the primary blast chamber. Temperature and pressure levels would typically be highest in this first chamber 370-1.

In some embodiments, the plugs 210 are threadedly attached to the housing 204 via the openings 208. In other embodiment, the plugs 210 are molded to the housing 204 and/or into the openings 208. In some embodiments, the openings 208 are positioned in closer proximity to the proximal end 216-1 than the distal end 216-2.

In some embodiments, the core 206 also includes a material that is not suitable for use with a firearm but which is suitable for use with an air gun. For example, the core 206 includes a material configured to yield and/or fracture in response to a firearm attached to the moderator 100 being discharged. Specifically, the core 206 includes a material configured to yield and/or fracture in response to a projectile being discharged from a fire arm and passing through an entrance 328 to the first chamber 370-1 of the core 206. The material yields and/or fractures in response to a high temperature resulting from discharging a firearm. The material may also yield and/or fracture in response to exposure to the air pressure created by discharging a firearm, but the material is of sufficient strength to withstand discharge of an air gun. The material includes, for example, a polycarbonate material. In some embodiments, the material of the core 206 yields in response to exposure of temperatures greater than or equal to 215 degrees Fahrenheit.

The housing 204 is attached to a gun via an attachment element 218 positioned at the proximal end 216-1. In some embodiments, the attachment element 218 is configured to removably attach to a gun. For example, the attachment element 218 attaches to a barrel, a muzzle, or a shroud of the gun.

In some embodiments, as illustrated in FIG. 2, the attachment element 218 includes features within a hollow portion 205 of the housing 204, such as threaded elements. As illustrated in FIG. 2, the attachment element 218 is threadedly configured to mate with a threaded portion of the gun. For example, the attachment element 218 includes a plurality of female threaded portions configured to receive a plurality of male threaded portions that are positioned on an end of a barrel of a gun. In such embodiments, the moderator 100 is configured to be attached to a gun, for example, by twisting the moderator 100 onto the barrel of the gun. In some embodiments, the attachment element 218 is specifically configured to attach the housing 204 to a gun that is an air gun and not a firearm. For example, in some embodiments, the attachment element 218 includes a thread pitch (or distance between threaded portions) that does not correspond to a thread pitch that would typically be in place on a firearm. Rather, the thread pitch corresponds to a thread pitch that is more commonly used for air guns. For example, the thread pitch of the attachment element 218 is compatible with an air gun with a ½"×20 Unified National Fine ("UNF") thread.

In some embodiments, the moderator 100 includes a cap 212 that is secured to a distal end 216-2 of the housing 204 that is opposite the proximal end 216-1 that is attached to the gun. In some embodiments, the cap 212 is threadedly attached to the distal end 216-2 of the moderator 100. The cap 212 includes at least one opening 266 to allow a projectile fired from the gun to pass through. The cap 212 secures elements of the moderator 100 with respect to one another. For example, the cap 212 is configured to hold the core 206 within the housing 204 and/or to secure disks 214 within the housing. The cap 212 is described in further detail in references to FIGS. 5A&B.

Figure 6:
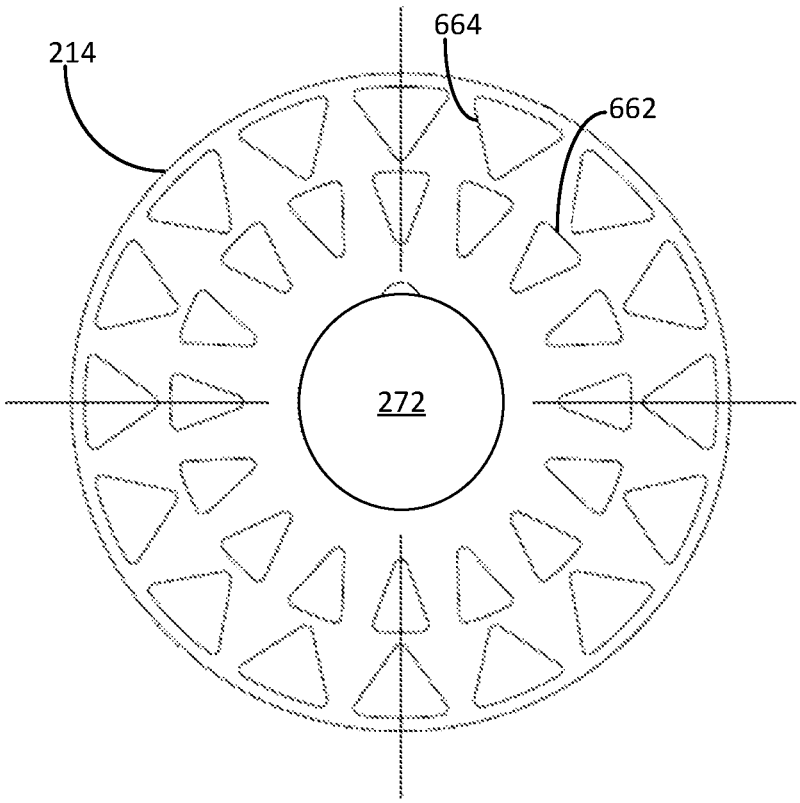
FIG. 6 is a front view illustrating a disk of a moderator, in accordance with one or more embodiments of the present invention.

In some embodiments, the moderator 100 includes one or more disks 214 positioned between the cap 212 and the core 206. The disks 214 include disk openings 272 to allow a discharged projectile to pass through the disk openings 272 and through the opening 266 of the cap. An embodiment of a disk 214 is illustrated in FIG. 6 and described in connection therewith.

Figure 3A:
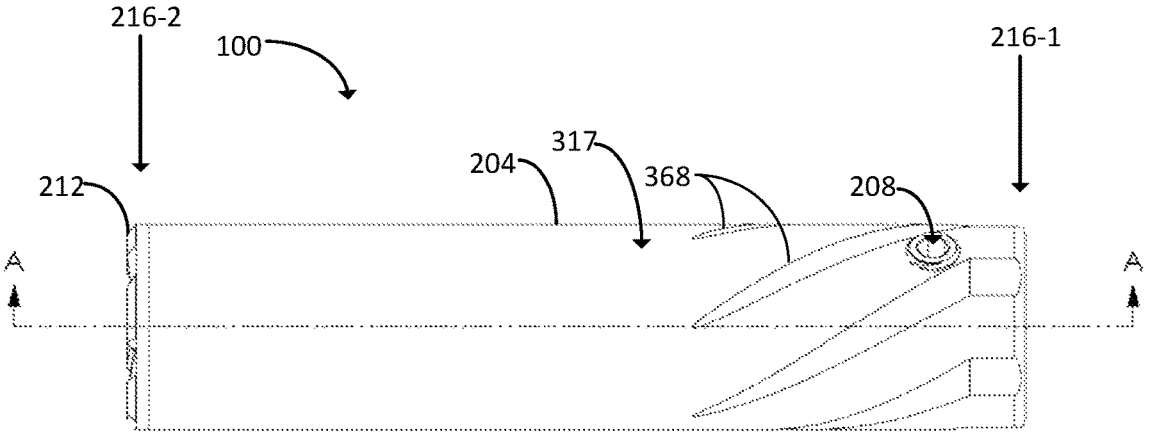
FIG. 3A is a side view illustrating one embodiment of an assembled air gun moderator in accordance with one or more embodiments of the present invention.
Figure 3B:
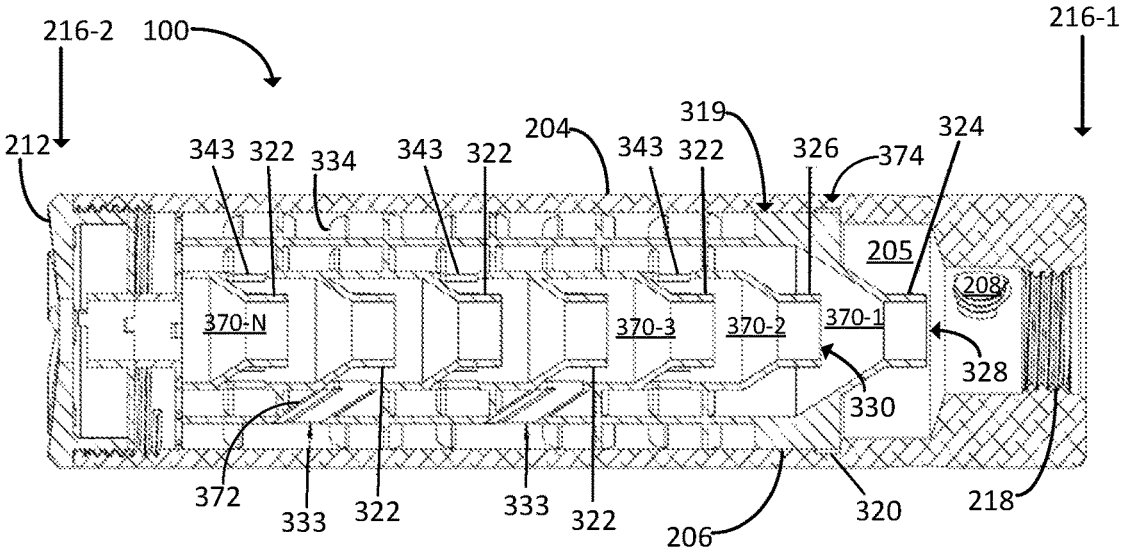
FIG. 3B is a cross-sectional view illustrating the air gun moderator of FIG. 3A, in accordance with one or more embodiments of the present invention.

FIG. 3A is a side view illustrating one embodiment of an assembled air gun moderator 100 in accordance with one or more embodiments of the present invention. When the moderator 100 is assembled, the core 206 is within the housing 204 and thus not visible in FIG. 3A. The cap 212 is attached to the distal end 216-2 of the housing 204 to secure internal contents, such as the disks 214 and the core 206. FIGS. 3A and 3B illustrate the openings 208 in proximity to the proximal end 216-1 and without the plugs 210.

In some embodiments, the housing 204 includes one or more weakening elements configured to reduce the tensile strength of the housing 204 and render it unsuitable for use with a firearm. Such elements reduce the thickness of the housing 204 in certain portions of the housing 204. For example, although not pictured, in some embodiments, the housing includes a number of holes extending only partially through the housing 204. In some embodiments, the housing 204 includes fluting 368, which includes curved depressions positioned on an exterior surface 317 of the housing 204. In some embodiments, the housing 204 includes a depression 320 positioned on an exterior surface 317 or, as shown in FIG. 3B, an interior surface 319. These elements lower the tensile strength of the housing 204, such that the housing 204 does not have sufficient tensile strength to withstand discharge of a firearm attached to the moderator 100. However, in many embodiments, the weakening elements are configured not to reduce the thickness of portions of the housing 204 so much as to render the housing 204 unable to withstand a discharge of a projectile from an air gun attached to the moderator 100.

FIG. 3B is a cross-sectional view illustrating the moderator 100 of FIG. 3A along the plane 'A', in accordance with one or more embodiments of the present invention. As shown in FIG. 3B, the housing 204 includes a core 206 disposed within a hollow portion 205.

The core 206 controls the travel of gasses emitted from muzzle of the gun behind the gun's projectile when the projectile is discharged from the gun. In some embodiments, the core 206 also slows the travel speed of the projectile from the gun once it leaves the muzzle and enters the moderator 100. Controlling the spread of gasses and speed of the projectile helps to reduce sound associated with discharge and helps to reduce blowby effects, therefore increasing shooting accuracy and helping to increase chances of hitting a target.

As shown in FIG. 3B, the core 206 is disposed within the housing 204. Specifically, the core 206 is disposed within the hollow portion 205 of the housing 204. In some embodiments, the hollow portion 205 is shaped such that portions of the core 206 form a friction fit with the housing 204 to secure the core 206 within the housing 204. For example, pockets 334 of an outer portion 324 of the core 206 contact an interior surface 319 of the housing 204.

The core 206 includes a number of chambers 370-1, . . . , 370-N. The core 206 includes a first chamber 370-1 configured to receive a projectile from the gun. When the projectile is fired from the gun, it enters the first chamber 370-1 through a first entrance 328. The projectile then travels through the first chamber 370-1 and into a second chamber 370-2 via an entrance 330 to the second chamber 370-2. As such, the second chamber 370-2 is configured to receive the projectile from the first chamber 370-1. The projectile then travels through each of the subsequent chambers 370-3, . . . , 370-N before exiting an opening 266 at the distal end 216-2 of the moderator 100, which is illustrated in FIG. 2.

In some embodiments, each entrance to a chamber (e.g., entrance 330 to the second chamber 370-2) is defined by an extended bore channel 322. The extended bore channels 322 increase pressure between an exterior of a projectile and the wall of the chambers 370. This increased pressure helps to limit turbulence of the core 206 during and immediately after discharge and helps to improve accuracy.

Figure 4A:
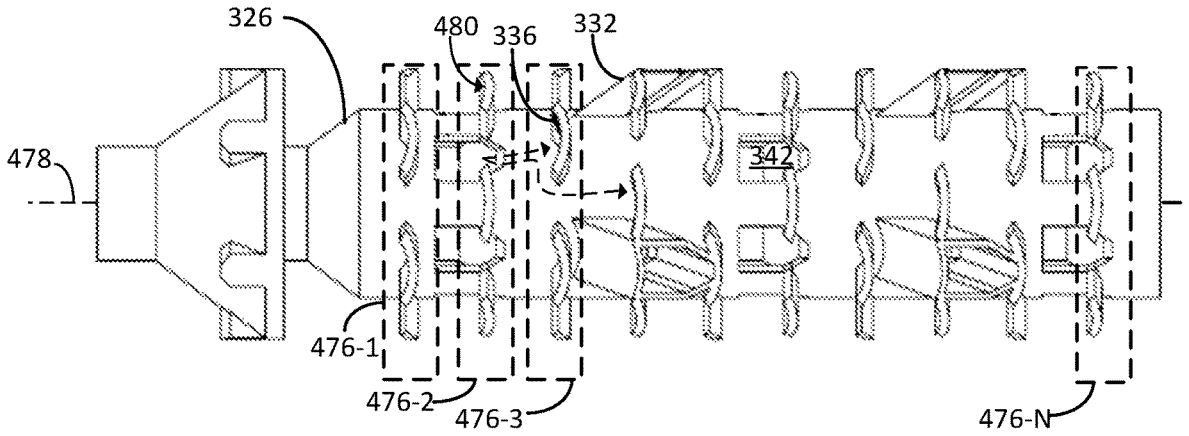
FIG. 4A is a side view illustrating an embodiment of an outer core of a moderator, in accordance with one or more embodiments of the present invention.
Figure 4B:
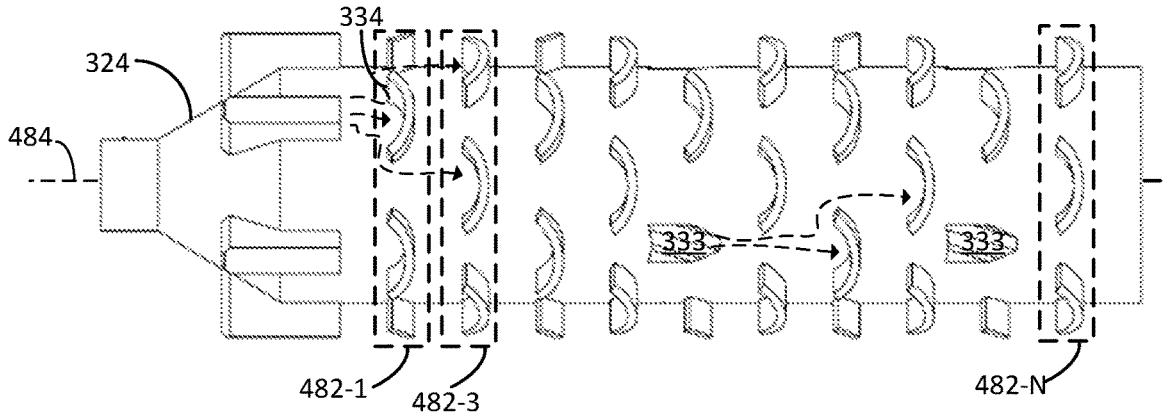
FIG. 4B is a side view illustrating an embodiment of an inner core of a moderator, in accordance with one or more embodiments of the present invention.

In some embodiments, the core 206 is a multi-layer core that includes an inner core 326 (an embodiment of which is illustrated in FIG. 4B) and an outer core 324 (an embodiment of which is illustrated in FIG. 4A). The inner core 326 is disposed within the outer core 324. In some embodiments, the first chamber 370-1 of the core 206 is a chamber of the outer core 324. Each of the other chambers 370-2, . . . , 370-N are chambers of the inner core 326.

In some embodiments, the core 206 is made of a material having a yield and tensile strength that is sufficiently low such that the material deforms and/or fractures in response to exposure to at least one of a temperature resulting from discharging a firearm attached to the moderator 100 and/or a pressure level resulting from discharging a firearm attached to the moderator 100. For example, the core 206 is made of a polycarbonate material. In some embodiments, both the inner core 326 and the outer core 324 include one or more materials configured not to withstand a temperature and/or pressure level of a firearm discharge. In other embodiments, one of the inner core 326 and the outer core 324 include one or more materials configured not to withstand a temperature and/or pressure level of a firearm discharge, while the other one of the inner core 326 and the outer core 324 does not include any materials configured not to withstand a temperature and/or pressure level of a firearm discharge. The inner core 326 and the outer core 324 each include materials configured to withstand the discharge of a projectile from an air gun.

In some embodiments, the core 306 does not include any materials that are of insufficient yield and tensile strength to cause them to deform and/or fracture in response to exposure to a firearm discharging. As such, in some embodiments, the core 306 may be used in connection with a moderator 100 attached to a firearm. In some embodiments, the housing 204 is also of sufficient tensile and yield strength to withstand the discharge of the firearm. As such, the housing 204, in such embodiments, does not include weakening elements, materials with insufficient tensile and yield strength to withstand the temperatures and/or pressure levels typical of firearm discharge, or plugs including such materials.

As described in connection with FIGS. 4A and B, in some embodiments, the inner core 326 includes a number of inner pockets 336 configured to slow the travel of a portion of the airflow that enters into the first chamber 370-1. The inner core 326 also includes a number of vents 332 configured to direct a portion of airflow to the outside of the outer core 324. With a portion of the air flow traveling between the inner core 326 and the outer core 324 and another portion of the air flow traveling between the outer core 324 and the interior surface 319 of the housing 204, the core 206 creates a dual-layer air flow.

As described in connection with FIGS. 4A and B, in some embodiments, the outer core 324 includes a number of pockets 334 configured to slow the travel of portions of airflow that are directed to an exterior of the outer core 324 through the vents 332.

In some embodiments, the housing 204 includes a weakening element. For example, the interior surface 319 includes a weakening element, such as a depression 320. As referred to herein, a "depression" includes, in some example, a groove. The depression 320 reduces a thickness of a portion 374 of the housing 204 with respect to a remainder of the housing 205 to reduce the tensile strength of the housing 204. In other words, the depression 320 has a depth sufficient to cause the housing 204 to yield and/or fracture in response to exposure to discharging a projectile through the moderator 100 via a firearm. For example, the depression 320 has a depth sufficient to reduce the strength of the housing 204 to cause the housing 204 to yield and/or fracture upon exposure to an increase in temperature as a result of the discharging of a firearm. The depression 320 may, additionally or alternatively, have a depth sufficient to reduce the strength of the housing 204 to cause the housing 204 to yield and/or fracture upon exposure to pressure levels created by the discharging of a firearm attached to the moderator 100. However, the portion 374 is still sufficiently thick to withstand any forces and/or temperature increases created by discharging an air gun attached to the moderator.

In some embodiments, the depression 320 is sufficient alone to cause the moderator 100 to malfunction or fail when used with a firearm rather than an air gun. For example, although the housing 204 is described above as including a material that would yield upon exposure to gunpowder combustion, the housing 204 can, in other embodiments, include a material typically sufficient to withstand discharge of a firearm, such as 7075 T6 aluminum. In some embodiments, the depression 320 is of a depth sufficient to cause the housing 204 to yield and/or fracture in response to exposure to discharge of a firearm, even if the material of the housing 204 would not yield without the depression 320. Other embodiments of the moderator 100 include both a weakening element, such as the depression 320, and a material configured to yield and/or fracture in response to exposure to the discharging of a firearm.

Although only two grooves 320 are shown in FIG. 3B, embodiments of the present disclosure are not so limited. For example, the housing 204 includes, in some embodiments, a single groove. In other embodiments, the housing 204 includes multiple grooves 320, with a depression 320 positioned between each subsequent entrance to a chamber 370-1, . . . , 370-N of the core 206.

As shown in FIGS. 2 and 3A, in some embodiments, the housing 204 is substantially cylindrical in shape. In such embodiments, the housing 204 resembles a tube. In some embodiments, the housing 204 includes a hollow portion 205. A depression 320 spans a circumference of the hollow portion 205 of the housing 204. In other embodiments, the depression 320 spans only a portion of the circumference of the hollow portion 205 of the housing 204. The portion of the circumference which the depression 320 spans has a length sufficient to reduce the tensile strength of the housing 204 such that the housing will yield and/or fracture in response to a firearm discharging a projectile through the moderator 100 while also retaining enough tensile strength of the housing 204 to allow the housing 204 to withstand the discharging of an air gun. In some embodiments, at least a portion of the hollow portion 205 is also substantially cylindrical in shape.

In some embodiments, the weakening depression 320 is positioned between an entrance 328 to the first chamber 370-1 and an entrance 330 to the second chamber 370-2. In some embodiments, other weakening elements, such as partial holes, are positioned between the first entrance 328 and second entrance 330. Positioning weakening elements in this manner causes the weakening elements to reduce the thickness of the housing 204 in a portion of the moderator 100 that experiences higher levels of pressure and temperature from the discharge of a projectile than other portions of the moderator. Weakening the housing 204 between the entrance 328 to the first chamber 370-1, which, in some embodiments, is a primary blast chamber, and the second chamber 370-2 helps to ensure that the housing 204 will not be compatible for use with firearms.

FIG. 4A is a side view illustrating an embodiment of an inner core 326 of a moderator 100, in accordance with one or more embodiments of the present invention. As shown in FIG. 4A, the inner core 326 includes a number of openings 342 and a number of vents 332. Hence, air flow is directed from an interior of the inner core 326 (i.e., from the chambers 370-2, . . . , 370-N illustrated in FIG. 3B to either an exterior of the inner core 326 via the openings 342 or to an exterior of the outer core 324 via the vents 332 and the vent openings 333 illustrated in FIG. 4B. In other words, air flows out of an interior of the inner core 326 either (1) via the openings 342 and throughout a space between the inner core 326 and the outer core 324 or (2) via the vents 332 and throughout space between the outer core 324 and the interior surface 319 of the housing 204. As such, the core 206 including the outer core 324 and the inner core 326 creates two layers of air flow by directing at least a portion of the air flow out of the inner core 326. The multiple layers help to improve attenuation of sound from the discharge of a gun and also diffuse energy from the air flow.

Air that flows out of the openings 342 travels along the length of the inner core 326 and is controlled by a number of inner pockets 336. The inner pockets slow the flow of air to help reduce the noise and blowby effects associated with discharging a gun. As illustrated in FIG. 4A, each row 476-1, . . . , 476-N of inner pockets 336 is offset from each adjacent row in a direction that is substantially perpendicular to a center line 478 of the inner core 326. For example, row 476-3 is offset from adjacent row 476-2. Furthermore, each pocket 336 is at least slightly curved, a concave portion 380 of the curve facing oncoming airflow. As such, each inner pocket 336 blocks the flow of air until the pocket 336 is full of air. At that point, air begins to overflow out from the sides of the pocket 336. Because the adjacent row (e.g., row 476-3) of inner pockets 336 is offset, the pockets 336 of that row are optimally positioned to receive the overflow from the pockets of the other row (e.g., row 476-2).

As illustrated in FIG. 4A, in some embodiments, a number of the inner pockets 336 are in contact with and/or attached to at least one of the vents 332. In some embodiments, a number of the inner pockets 336 are substantially aligned with an opening 342 in a direction parallel to the center line 478. This alignment helps to ensure that air flow coming out of the opening 342 is controlled by the inner pockets 336.

In some embodiments, the vents 332 extend outward from the inner core 326 at an angle with respect to the center line 480 of the inner core 326. As illustrated in FIG. 4A, the vents 332, in some embodiments, include six walls. However, embodiments of the present disclosure are not so limited, and the vents 332 can be of any shape suitable to permit the passage of air into an exterior of the outer core 324.

FIG. 4B is a side view illustrating an embodiment of an outer core 324 of a moderator 100, in accordance with one or more embodiments of the present invention. As illustrated in FIG. 4B, the outer core 324 includes a number openings 333 of the vents 332 illustrated in FIG. 4A. The outer core 324 also includes a number of outer pockets 334. In some embodiments, the outer pockets 334 are arranged in rows 482-1, . . . , 482-N. Each row (e.g., 482-2) is offset from an adjacent row (e.g., 482-1) in a direction that is substantially perpendicular to a center line 484 of the outer core 324 and/or of the core 306. In some embodiments, the center line 484 of the outer core 324 is substantially parallel to and/or the same as the center line 478 of the inner core 326.

Similar to the inner pockets 336 illustrated in FIG. 4A, the outer pockets 334 are slightly curved and thus configured to slow the flow of air. Once the outer pocket 334 is full, air overflows from an outer pocket 334 on a first row 482-1 and onto the adjacent row 482-2 of outer pockets 334. Because the adjacent row 482-2 is offset the adjacent row is optimally positioned to temporarily trap the air overflowing from the sides of the outer pockets 334. In some embodiments, the outer pockets 334 also temporarily trap the air flowing out of the vents 332 via the vent openings 333.

The outer core 324 and the inner core 326 illustrated in FIGS. 4A-B are embodiments of components of the core 206 illustrated in FIGS. 2 and 3A. Although embodiments of the present disclosure include a core 206 comprised of material to render the core 206 incompatible for use when the moderator 100 is attached to a firearm, embodiments of the core 206 are not so limited. For example, in some embodiments, the core 206 described herein is formed from a material suitable to withstand the discharge of a firearm. In such embodiments, the other components of the moderator 100 are also configured to withstand the discharge of a firearm.

Figure 5A:
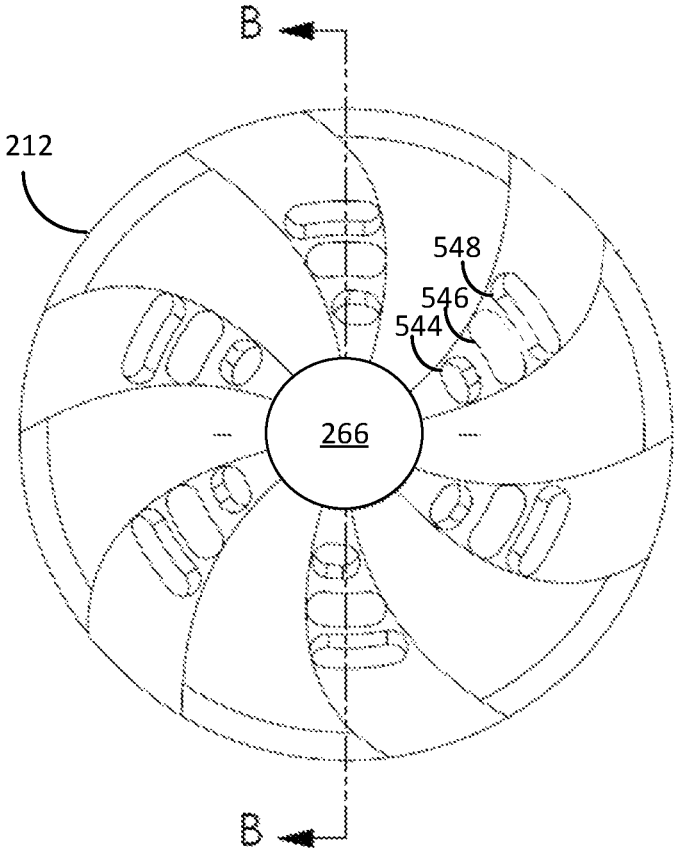
FIG. 5A is a front view illustrating a cap of a housing of a moderator, in accordance with one or more embodiments of the present invention.

FIG. 5A is a front view illustrating a cap 212 of a housing 204 of a moderator 100, in accordance with one or more embodiments of the present invention. As shown in FIG. 5A, the cap 212 includes an opening 266 configured to allow a projectile discharged from a gun to pass through the cap 212 and exit the moderator 100. The opening 266 is substantially circular in shape and positioned substantially central to the cap 212. Although not shown in FIG. 5A, in some embodiments, the opening 266 is aligned with a muzzle of the gun.

In some embodiments, the cap 212 includes one or more additional openings 544, 546, and 548. These openings 544, 546, and 548 are configured to release air from the moderator 100. The openings 544, 546, and 548 are, in some embodiments, of varying sizes. Each of the openings 544, 546, and 548 has a different circumference. The opening 544 with the smallest circumference is positioned closest to the opening 266 configured to allow the projectile to pass through. The opening 548 with the largest circumference is positioned furthest from the opening 266, and the opening 546 is positioned between the openings 544 and 548. Neither of the openings 544, 546, or 548 are of a sufficient circumference to allow a projectile to pass through.

Figure 5B:
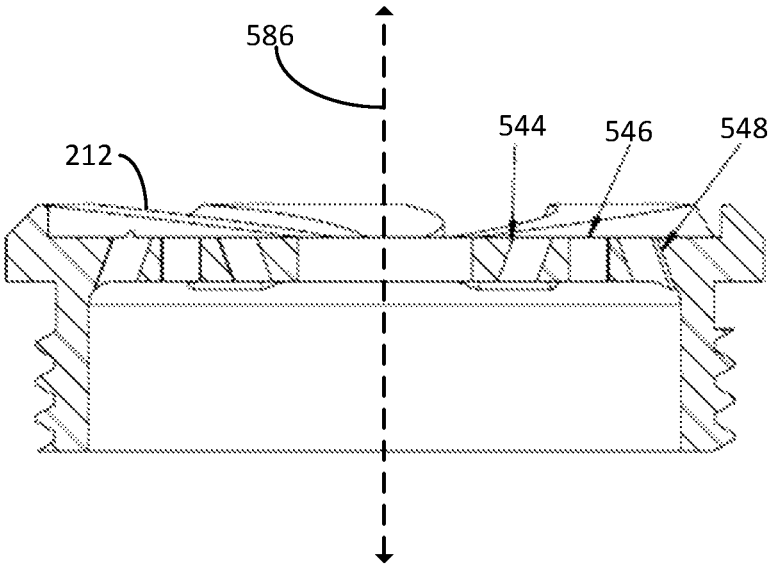
FIG. 5B is a cross-sectional view illustrating a cap attached to a housing of a moderator, in accordance with one or more embodiments of the present invention.

FIG. 5B is a cross-sectional view illustrating the cap 212 attached to a housing 204 of a moderator 100 along the plane 'B' in FIG. 5A, in accordance with one or more embodiments of the present invention. As illustrated in FIG. 5B, in some embodiments, a number of the openings 544 and 548 are angled with respect to a center line 586 of the cap 212. In some embodiments, the center line 586 of the cap 212 is substantially aligned with the center lines 484 and 478 of the outer core 324 and inner core 326.

FIG. 6 is a front view illustrating a disk 214 of a moderator 100, in accordance with one or more embodiments of the present invention. As described in connection with FIG. 2, the disk 214 is configured to be positioned between the cap 212 and the core 206. The disk 214 includes a central opening 272 shaped to allow a projectile discharged from a gun attached to the moderator 100 to pass through the disk 214. The disk 214 also includes a number of additional openings 662 and 664 to allow air to pass through the disk 214. In some embodiments, the disk 214 includes a number of smaller openings 662 to arranged in a circular fashion with respect to one another. The number of smaller openings 662 are concentric to a number of larger openings 664, the number of larger openings 664 also arranged in a circular fashion.

As illustrated in FIG. 2, some embodiments include multiple disks 214. In such embodiments, sound-attenuating or sound-absorbing material is placed between the disks 214. Embodiments include any material suitable for allowing air to pass through while absorbing and/or attenuating sound. The openings 662 and 664 are configured to allow air to pass through the material and through the disks 214.

Figure 7:
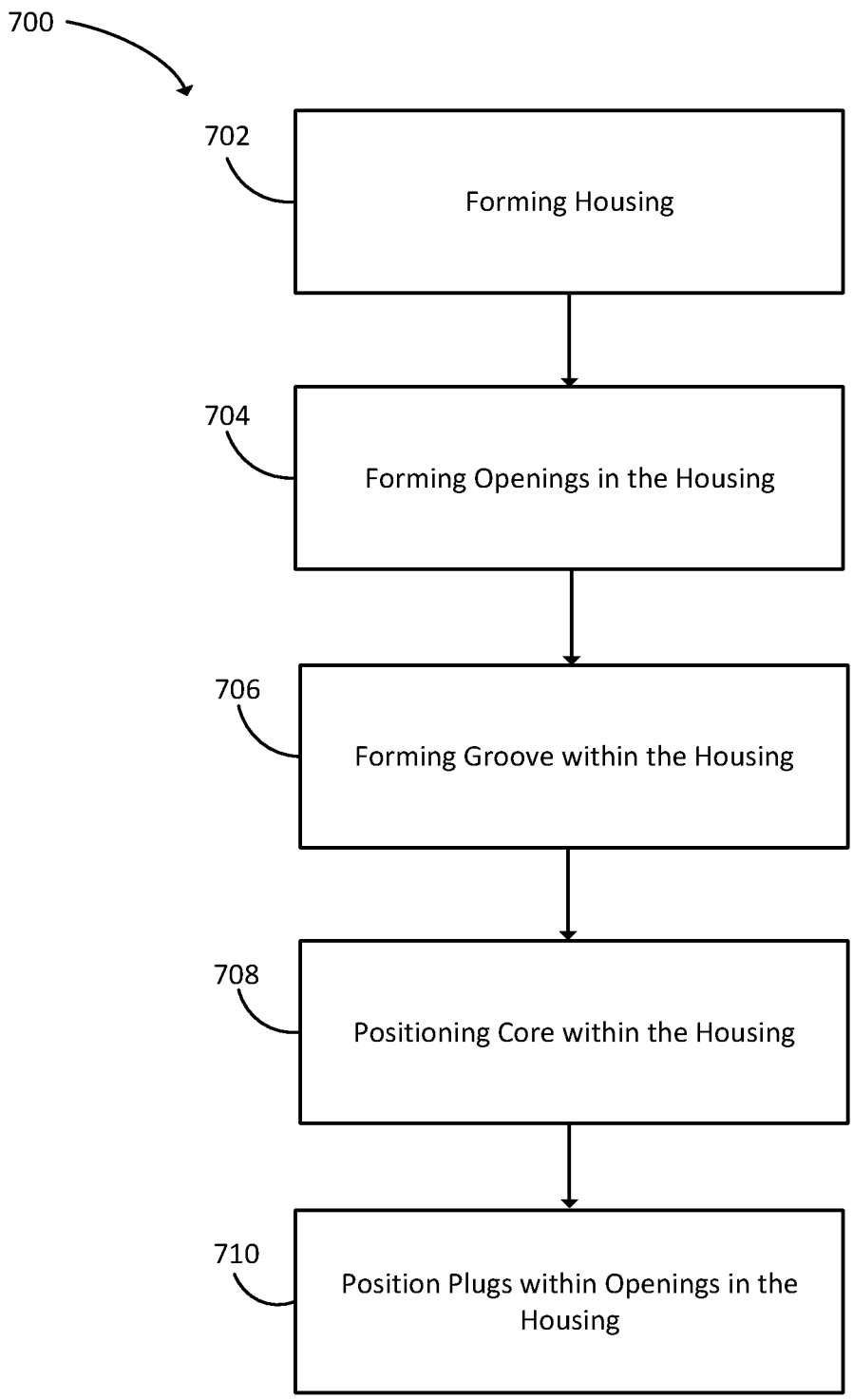
FIG. 7 is a schematic flow chart diagram illustrating one embodiment of a method of manufacturing an air gun moderator, in accordance with the present invention.

FIG. 7 is a schematic flow chart diagram illustrating one embodiment of a method 700 of manufacturing an air gun moderator 100, in accordance with the present invention. The method 700 begins and includes a first step 702 of forming a housing 204. The housing includes a proximal end 216-1 configured to attach to a gun such that, when the gun is discharged, a discharged projectile travels through the moderator 100 and exits the moderator through an opening 266 in the moderator 100 at a distal end 216-2.

Forming 702 the housing 204 includes configuring a proximal end 216-1 to attach to a gun and forming a hollow portion 205 within the housing 204. Forming 702 the housing 204 further includes forming 702 the housing 204 from a first material configured to yield and/or fracture in response to exposure to at least one of a pressure level resulting from discharge of a firearm and/or a temperature resulting from discharge of a firearm.

The method 700 includes forming 704 a number of holes 210 in the housing 204.

The method 700 includes a step 706 of forming a depression 320 within the hollow portion 205. The depression 320 has a depth configured to reduce a thickness of a portion 374 of the housing 204 with respect to a remainder of the housing 204. The depression 320 has a depth sufficient to cause the housing 204 to yield and/or fracture in response to exposure to at least one of a pressure level resulting from discharge of a firearm and/or a temperature resulting from discharge of a firearm.

The method 700 includes a step 708 of positioning a core 206 within the hollow portion 205. In some embodiments, the method also includes forming the core 206. The core comprises both an inner core 336 and an outer core 334. However, the core 206, in some embodiments, is a monolithic structure. In other embodiments, the core 206 is modular. In such embodiments, the inner core 336 and outer core 334 are formed separately and are removable with respect to each other. In some embodiments, the core 206 is formed via 3D printing and/or injection molding.

The core 206 includes a number of chambers 370-1, . . . , 370-N configured to receive a projectile discharged from the gun. In some embodiments, the method 700 further includes forming the core 206 from a second material configured to yield and/or fracture in response to exposure to at least one of a pressure level resulting from discharge of a firearm and/or a temperature resulting from discharge of a firearm. In some embodiments, forming the core 206 includes forming an inner core 326 and an outer core 324 and positioning the inner core 326 within the outer core 324.

The method 700 includes a step 710 of positioning a number of plugs 210 into the number of openings 208. In some embodiments, each plug 210 includes a material configured to yield and/or fracture in response to exposure to at least one of a pressure level resulting from discharging a firearm and/or a temperature resulting from discharging a firearm.

As used herein, the term "gun" may refer to any device configured to propel projectiles by explosive force. The term "gun" includes both air guns and firearms. In other words, the term gun, as used herein, includes both guns that discharge projectiles using energy from compressed gases and guns that discharge projectiles using energy created by burning combustible propellants, such as gunpowder. An air gun includes, for example, an air gun.

As used herein, the term "air gun" may refer to any gun (e.g., an air rifle) that uses compressed air to discharge a projectile. Air gun projectiles include, for example, pellets, BBs, slugs, darts, or arrows. The term "air gun" refers to guns that are not subject to the same regulations as firearms.

As used herein, the term "firearm" includes any gun configured to use a propellant charge (e.g., gun powder combustion) to discharge a projectile. Firearms can include metal cartridges. Projectiles discharged from a firearm include, for example, bullets.

As used herein, the term "moderator" may refer to any device, system, or apparatus configured to quiet or silence a gun and/or control expulsion of a projectile and/or gasses from the gun. As used herein, the term "moderator" includes, but is not limited to, moderators, suppressors, silencers, and mufflers configured for use with guns. Unless specifically referred to as an "air gun moderator" herein, the term "moderator" may be used to describe a moderator for use with a firearm or a moderator for use with an air gun.

As used herein, the term "yield" may refer to experiencing a temperature and/or pressure level that exceeds the materials elastic limit, causing the material to permanently deform. The term "yield" may also refer to the material reaching its yield point. As described herein, materials that are configured to "yield" in response to exposure to a certain temperature and/or pressure level include materials that have a yield and tensile strength sufficiently low to deform and/or fracture in response to exposure to the temperature and/or pressure level.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An air gun moderator, comprising:

a housing configured to attach to an air gun and comprising:

a first material configured to yield and/or fracture in response to exposure to at least one of a pressure level resulting from discharging a firearm and/or a temperature resulting from discharging a firearm; and a number of openings positioned in proximity to an end of the housing; and a number of plugs, each plug comprising a second material configured to yield and/or fracture in response to exposure to at least one of a pressure level resulting from discharging a firearm and/or a temperature resulting from discharging a firearm; and wherein each opening of the number of openings is configured to receive a plug of the number of plugs.

2. The moderator of claim 1, wherein each of the first material and the second material are further configured not to yield and/or fracture at a temperature and pressure level resulting from discharging the air gun.

3. The moderator of claim 1, wherein at least one of the first material and the second material is configured to yield and/or fracture at a temperature that is sufficiently low to render the at least one material unsuitable for use if the moderator is attached to a firearm.

4. The moderator of claim 3, wherein the at least one material is configured to yield and/or fracture at a temperature of no greater than 215 degrees Fahrenheit.

5. The moderator of claim 4, the housing further comprising at least one of the following: a depression, a number of holes extending only partially through the housing, and/or fluting positioned on an exterior surface of the housing.

6. The moderator of claim 5, the housing further comprising a hollow portion, wherein:

the housing is substantially cylindrical in shape; and the depression spans a circumference of the hollow portion.

7. The moderator of claim 6, further comprising a core disposed within the hollow portion, the core comprising a first chamber configured to receive a projectile from the gun and a second chamber configured to receive the projectile from the first chamber.

8. The moderator of claim 7, wherein the depression is positioned between an entrance to the first chamber and an entrance to the second chamber.

9. The moderator of claim 6, the core comprising a third material having a yield and tensile strength sufficiently low such that the third material deforms and/or fractures in response to exposure to at least one of a temperature resulting from discharging a firearm and/or a pressure level resulting from discharging a firearm.

10. The moderator of claim 1, further comprising an attachment element positioned at the end and configured to removably attach to at least one of a muzzle, a barrel, or a shroud of the air gun.

11. The moderator of claim 1, wherein the number of plugs are further configured to yield and/or fracture at a temperature that is less than a temperature at which the housing is configured to yield and/or fracture.

12. The moderator of claim 1, the first material comprising an aluminum alloy.

13. The moderator of claim 1, the first material having a sufficiently low tensile and yield strength such that at least one of the moderator or a component of the moderator is not compatible with a gun attached to the housing if the gun comprises a firearm.

14. The moderator of claim 1, further comprising a cap configured to attach to a second end of the housing, the cap comprising at least one opening configured to allow a projectile discharged from the air gun to pass through the cap.

15. An air gun moderator, comprising:

a housing configured to attach to an air gun and comprising a depression, the depression having a depth configured to reduce a thickness of a portion of the housing with respect to a remainder of the housing and sufficient to cause the housing to yield and/or fracture in response to exposure to at least one of a pressure level resulting from discharging a firearm and/or a temperature resulting from discharging a firearm;

a first chamber disposed within the housing and positioned such that a projectile discharged from the air gun passes through an entrance to the first chamber;

a second chamber disposed within the housing and positioned such that the projectile passes through an entrance to the second chamber after passing through the entrance to the first chamber, wherein the depression is positioned between the entrance to the first chamber and the entrance to the second chamber.

16. The moderator of claim 15, wherein:

the first chamber and the second chamber comprise a first chamber and a second chamber of a number of chambers of a core disposed within the housing; and the core comprises a material configured to:

yield in response to exposure to at least one of a pressure level resulting from a discharging of a projectile from a firearm through the entrance to the first chamber and/or a temperature resulting from a discharging of a projectile from a firearm to the entrance of the first chamber; and not yield in response to a discharging of a projectile from the air gun and through the entrance to the first chamber.

17. The moderator of claim 16, the material comprising a first material and the housing further comprising a second material configured to yield and/or fracture in response to exposure to at least one of a pressure level resulting from discharging a firearm and/or a temperature resulting from discharging a firearm.

18. The moderator of claim 17, wherein at least one of the first material and the second material are configured to yield and/or fracture at a temperature no greater than 215 degrees Fahrenheit.

19. The moderator of claim 17, the material comprising a first material and the housing further comprising a second material configured not to yield and/or fracture in response to exposure to a pressure level resulting from discharging a firearm or a temperature resulting from discharging a firearm.

20. A method of manufacturing a moderator for an air gun, comprising:

forming a housing, the housing comprising:

a first end configured to attach to an air gun;

a hollow portion; and a first material configured to yield and/or fracture in response to exposure to at least one of a pressure level resulting from discharge of a firearm and/or a temperature resulting from discharge of a firearm;

forming a number of openings in the housing;

forming a depression within the hollow portion, the depression having a depth configured to reduce a thickness of a portion of the housing with respect to a remainder of the housing and cause the housing to yield and/or fracture in response to exposure to at least one of a pressure level resulting from discharge of a firearm and/or a temperature resulting from discharge of a firearm;

positioning a core within the hollow portion, the core comprising:

a number of chambers configured to receive a projectile discharged from the air gun; and a second material configured to yield and/or fracture in response to exposure to at least one of a pressure level resulting from discharge of a firearm and/or a temperature resulting from discharge of a firearm; and positioning a number of plugs within the number of openings, each plug comprising a material configured to yield and/or fracture in response to exposure to at least one of a pressure level resulting from discharge of a firearm and/or a temperature resulting from discharge of a firearm.

* * * * *